United States Patent [19]

Brandell

[11] Patent Number: 4,872,671

[45] Date of Patent: Oct. 10, 1989

[54] EXERCISE DEVICE PROVIDING VARIED AND PREDETERMINED RESISTANCE

[75] Inventor: John R. Brandell, Barrington, Ill.

[73] Assignee: Ronlund Sports Products, Inc., Northbrook, Ill.

[21] Appl. No.: 227,804

[22] Filed: Aug. 3, 1988

[51] Int. Cl.[4] ..... A63B 21/02

[52] U.S. Cl. ..... 272/137; 272/135

[58] Field of Search ..... 272/135–139, 272/140, 142; 185/37, 39; 267/69

[56] References Cited

U.S. PATENT DOCUMENTS

| | | | |
|---|---|---|---|
| 3,137,366 | 6/1964 | Rassier | 185/39 |
| 3,454,274 | 7/1969 | Kaneshiro | 272/135 |
| 4,446,653 | 5/1984 | Morgan, Jr. | 185/37 |
| 4,681,317 | 7/1987 | Brandell | 272/137 |

FOREIGN PATENT DOCUMENTS

| | | | |
|---|---|---|---|
| 22615 | 7/1911 | Switzerland | 272/142 |

*Primary Examiner*—Richard J. Apley
*Assistant Examiner*—J. Welsh
*Attorney, Agent, or Firm*—Emrich & Dithmar

[57] ABSTRACT

An exercising device includes a pair of elongated handles each having an end portion and a gripping portion, with the end portions having an attached rotatable spinner members, with resilient elastic bands attached thereto, and wound together to define a substantially unitary resilient link between the handles interconnects the spinner members and providing a force against the relative movement of the handles with respect to each other to provide an isokinetic exercise device.

10 Claims, 2 Drawing Sheets

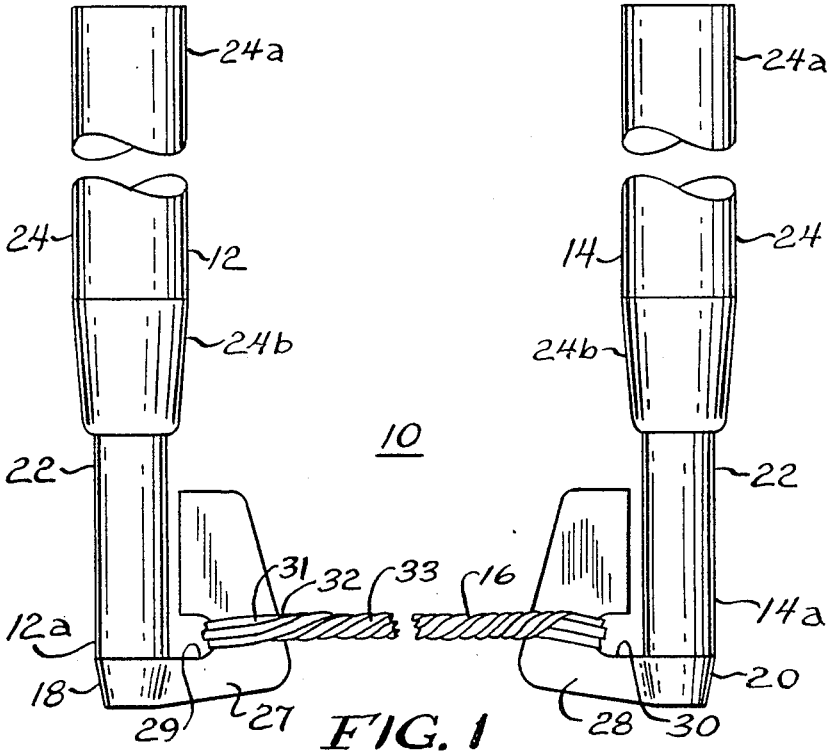
FIG. 1
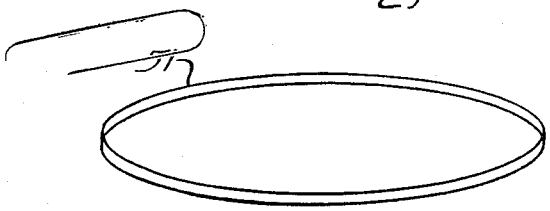
FIG. 2
FIG. 4
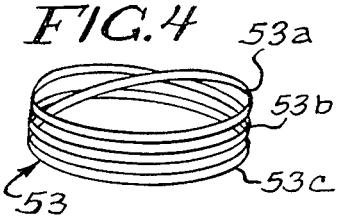
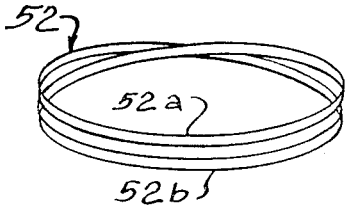
FIG. 3
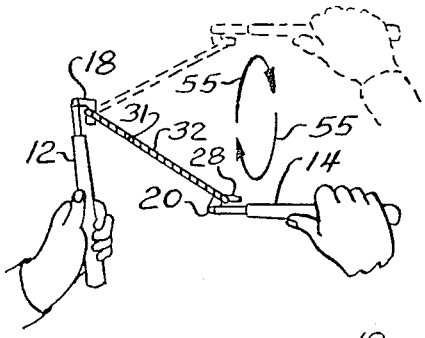
FIG. 6
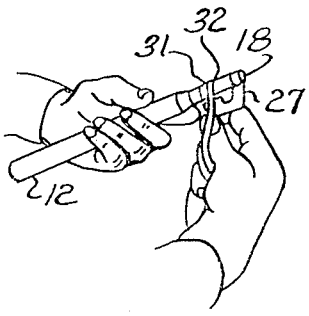
FIG. 5
FIG. 7
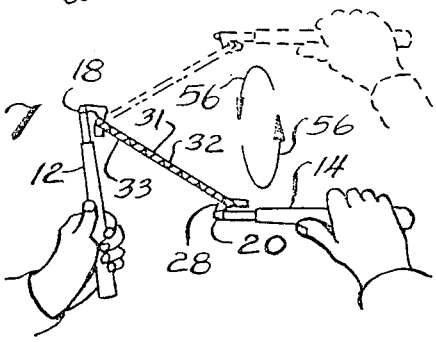

EXERCISE DEVICE PROVIDING VARIED AND PREDETERMINED RESISTANCE

BACKGROUND OF THE INVENTION

The present invention relates to an exercise device and, more particularly, to an exercise device for developing hand and arm muscles that are used extensively playing games, such as, golf, baseball, softball, tennis, bowling or the like.

Devices for exercising various muscles of the body have been suggested in the prior art. See, for example, U.S. Pat. Nos. 113,384, 1,123,272, 1,539,569, 3,807,730. Such devices, generally including a pair of handles connected together by springs or other type resilient member, permit the user to develop forearm and chest muscles through a limited range of movements and exercises. However, such exercise devices have limited usefulness because they do not provide the same level of resistance throughout the entire range of motion during usage of such exercise device. Thus, such devices only permit the user to experience isotonic muscle development through a limited range of movement. Additionally, such devices do not include handle or hand engaging members which correspond to the gripping member actually utilized in the particular intended sport and, accordingly, do not provide any exercise for development of the hand and forearm muscles necessary to compete in such sports.

To overcome the difficulty of the above described prior art exercise devices, it has been suggested in U.S. Pat. Nos. 2,848,234, 3,618,942 and 4,328,964 to utilize a single handle attached by some type of resilient means to a fixed wall structure. Such attachment to a fixed stationary object is designed to permit the user of such devices to exercise muscles through a limited range of movement. Again, such exercise devices only provide isotonic exercise results because they do not provide the same difficulty of resistance throughout the entire range of motion. Therefore, such devices provide only limited development of muscles.

In my U.S. Pat. No. 4,681,317 issued on July 21, 1987, there is disclosed an exercise device which permits an isokinetic exercise in that the maximum resistance is provided by the device for the hands and forearm muscles throughout the entire range of movement of the user of the device. The device comprises a pair of elongated handles having gripping portions thereon with the handles interconnected together at ends thereof by resilient members such as springs, rubber or elastic members, etc. The handles have spinner members which are freely rotatable in the ends of the handles and are adapted for the ready attachment of the elastic members to the handles so as to provide a variable isokinetic exercise device which provides maximum stress or resistance to muscle exercises over the entire range of movement of the exercise device.

SUMMARY OF THE INVENTION

It is one object of the present invention to provide an improved exercise device.

A further object of the present invention is to provide an improved isokinetic exercise device which provides maximum stress or resistance to muscle exercises through the entire range of movement of the exercise device.

Still another object of the present invention to is to provide a variable isokinetic exercise device.

Still another object of the present invention is to provide isokinetic exercise device which is simple in construction and inexpensive to manufacture and which is adaptable to provide a varied and predetermined resistance for exercising hand and forearm muscles.

The present invention has provided an exercising device comprising a pair of elongated tubular handles each having an end portion and a gripping portion extending substantially the length of the handles opposite the end portions, with each of the end portions providing a tubular shaft. Each of the end portions includes a spinner member having a hook portion. A resilient means is attached to hook portions of said spinner members to interconnect the ends of the handles. The resilient means applies a variable resistance against the reactive universal movement of the handles with respect to each other. The resilient means includes at least first and second members of a resilient material, with said first member being wound on said second member along substantially the entire length thereof.

The present invention consists of certain novel features and structural details hereinafter fully described, illustrated in the accompanying drawings, and particularly pointed out in the appended claims, it being understood that various changes in the details may be made without departing from the spirit, or sacrificing any of the advantages of the present invention.

DESCRIPTION OF THE DRAWINGS

For the purpose of facilitating and understanding the invention, there is illustrated in the accompanying drawings a preferred embodiment thereof, from an inspection of which, when considered in connection with the following description, the invention, its construction and operation, and many of its advantages will be readily understood and appreciated.

FIG. 1 is a side elevational view of one embodiment of the exercise device in accordance with the present invention;

FIG. 2 is an isometric view of a full-length band for use in the exercise device;

FIG. 3 is an isometric view of a looped band for use in the exercise device;

FIG. 4 is an isometric view of a double-looped band for use in the exercise device;

FIGS. 5–7 illustrate assembly of the power bands on the handles of the exercise device;

DESCRIPTION OF THE PREFERRED EMBODIMENT

Figure 8:
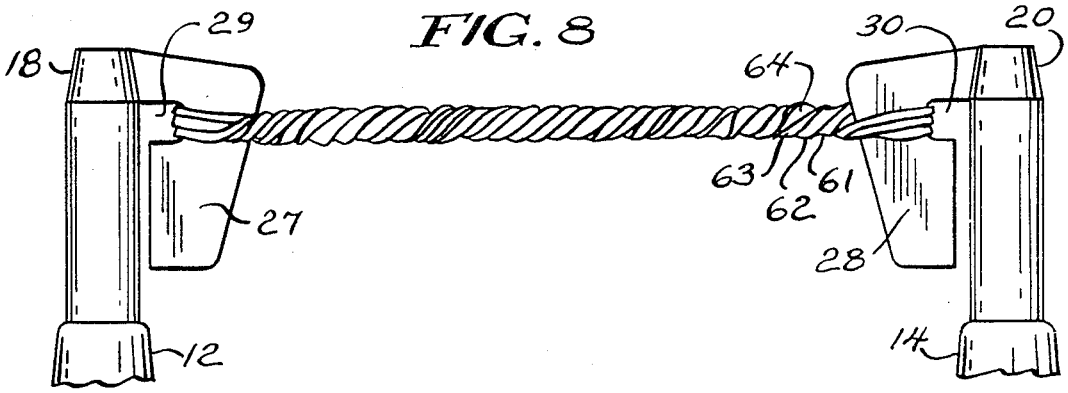
FIG. 8 is a fragmentary view of the exercise device illustrating one winding arrangement for a starting band for providing medium resistance for the exercise device.

Referring to FIG. 1, the exercise device 10 provided in accordance with the present invention includes a pair of elongated poles or handles 12 and 14, which are attached together at or adjacent tubular ends **12*a* and 14*a*, respectively, by a resilient link 16. The handles 12 and 14 have spinner members 18 and 20, respectively, defining respective hook portions 27 and 28 for attaching the resilient link 16 to the handles. The resilient link 16 applies a force against the relative movement of the handles with respect to each other. The spinner members 18 and 20 permit 360° of rotation around the tubular ends 12***a* and 14*a* of the handles.

In accordance with one aspect of the invention, the resilient link 16 comprises a plurality of resilient bands, which are wound or twisted together, with the stress or resistance provided by the bands varying from a low resistance value to a strong resistance value as a function of the number of bands used, the amount of stretch and the number of windings. In the embodiment for the exercise device illustrated in FIG. 1, three bands 31, 32 and 33 interconnect the handles 12 and 14. The amount of stretch of the bands can be changed by looping the bands prior to attaching the bands to the handles.

The use of the spinner members 18 and 20 to attach the bands 31–33 to the handles 12 and 14, both facilitates changing the number of bands used and varying the number of windings of the bands to obtain the desired resistance. Thus, the user can begin an exercise with the exercise device 10 configured to provide a low-resistance, and the resistance can be gradually increased as the muscles of the user become strengthened.

More specifically, preferably, each of the handles 12 and 14 is comprised of a elongated metallic tube 22 approximately twelve inches in length upon which a conventional grip 24 such as a golf grip, of approximately eight to eleven inches in length, is securely mounted, as is well known in the art. The grip 24 may be comprised of rubber, plastic, or leather to provide a hand engaging or grip portion for the handles 12 and 14. However, the handles 12 and 14 may be comprised of an elongated rod composed of metal, wood, plastic and the like. If desired, the handles 12 and 14 may be fitted with a gripping portion simulating a handle of a tennis racket or of a baseball bat, the structures of which are well known in the art.

The exercise resistance also varies as function of the user's hand position on the grips. The substantial length of the hand engaging or gripping portion 24 permits the user of the exercise device 10 to vary the resistance of the resilient link 16 by engaging the grip portion 24 adjacent the area where the resilient bands are secured to the handle or adjacent the other end of the handle, or any position for varying the degree of resistance of the resilient link. When the user's hands engage the handles at the bottom 24*a* of the grips, resistance is four times greater than when the hands are placed at the top 24*b* of the grips.

The handles 12 and 14, including the associated spinner members 18 and 20 may be similar to those disclosed in my U.S. Pat. No. 4,681,317. As is fully described in the referenced patent, the handles 12 and 14 each include a sleeve-bearing member (not shown) which is adapted to be received within the metallic tubular ends 12*a* and 14*a* and held therein in a suitable manner, such as by crimping to firmly retain the sleeve-bearing within the ends of the tubular ends. Each of the spinner members 18 and 20 is adapted to be received within the corresponding sleeve-bearing and to be retained within the sleeve-bearing and to permit 360° of rotation around the tubular ends 12*a* and 14*a* of the handles.

Each of the spinner members 18 and 20 defines a respective hook portion 27 and 28, each provided with a generally semi-circular cutout 29 and 30 which facilitates attachment of the bands 31–33 to the spinner members 18 and 20.

The spinner members 18 and 20 each comprise a die cast metal or alloy or may be comprised of a hard plastic material, such as Lexan, a polymer material which possesses the necessary strength and rigidity to withstand the forces exerted by the bands 31–33 during exercising movements. The spinner members 18 and 20 permit also the continuous alignment of the stretched bands 31–33 between the ends during movement of the pair of handles 12 and 14 with respect to one another.

The bands 31, 32 and 33 for the exercise device 10 illustrated in FIG. 1 include two bands 31 and 32, referred to as starting bands, which are twisted together to impart a twisting torque thereto. The third band 33 serves as a locking band which is twisted onto the start bands 31 and 32 after they have been twisted together to overcome the twisting torque. It is significant that the band include at least one starting band of a resilient material wound in one direction to impart a twisting torque thereto and at least one locking band of a resilient material wound on said starting band in the opposite direction to equalize the twisting torque.

The starting bands 31 and 32 may comprise a single band, such as band 51 illustrated in FIG. 2, a single looped band, such as band 52 illustrated in FIG. 3 or a double looped band, such as band 53 illustrated in FIG. 4. The single looped band 52 comprises a single band, such as band 51, which is looped over upon itself to form two loops 52*a* and 52*b*. The double looped band 53 comprises a single looped band, such as band 52, which is looped over upon itself to form three loops 53*a*, 53*b*, and 53*c*. The locking band 33 (FIG. 1) comprises a single band, such as band 51. The single band 51 comprises an endless loop of rubber or other suitable elastic material which, for example, may be approximately 15 inches in circumferential length. As indicated, looping the band 51 to provide the looped band 52 or double looped band 53 results in an increased resistance for the exercise device 10. Thus, the same band can provide different predetermined resistances as a function of the number of loops it forms.

With reference to FIGS. 5–7, in installing the bands 31–33 on the handles 12 and 14, first the starting bands 31 and 32 are looped over the hook portion of one of the handles, such as handle 12. The two starting bands, untwisted, are looped around the hook portion 27 of the spinner member 18 of handle 12 while the user grips the handle 12 in his hand. Then, the other ends of the two starting bands 31 and 32 are looped around the hook portion 28 of the spinner member 20 of the other handle 14. The bands 31 and 32 are stretched slightly when sliding them into position on the spinner members. When the starting bands 31 and 32 are positioned on the spinner members, they are twisted or wound together by rotating one of the handles such as handle 14, relative to the other handle 12 using a clockwise or counterclockwise movement. For example, when the exercise device is to be used by a right handed person, the starting bands are twisted or wound clockwise as illustrated in FIG. 6 in the direction of the arrows 55 in FIG. 6. The direction of winding is reversed if the user is left handed. The number of turns that the starting bands 31 and 32 are wound clockwise is a factor in determining the resistance.

When the starting bands 31 and 32 have been wound the prescribed number of turns clockwise in the direction of the arrows 56, the windings for the exercise device appears similar to those for the embodiment illustrated in FIG. 8 which has four starting bands 61–64. The locking band 33 is installed on the spinners 18 and 20, overlying the wound starting bands 31 and 32. The locking band 33 is then wound counter-clockwise by rotating handle 14 relative to handle 12 as shown in FIG. 7, the number of turns to equalize the twisting torque. During the winding process for the starting bands 31 and 32, the bands are stretched by pulling the handles 12 and 14 in opposite directions, to eliminate torque-knots. The result is similar to that shown in FIG. 9 for the device which has four starting bands 61–64 and locking band 65. The bands 31–33 are kept stretched when winding the locking band 33 to balance the twisting forces.

While the exemplary embodiment for the exercise device 10 illustrated in FIG. 1, has two starting bands 31 and 32 and one locking band 33, different combinations of types of starting bands, i.e. looped or non-looped, and numbers of starting bands may be employed with different winding specifications to provide different exercise resistances. Examples of which are set forth in TABLE I, TABLE II and TABLE III.

TABLE I

| | SINGLE BAND | |
|---|---|---|
| Resistance | No. Start Bands | No. Turns |
| 1 Low | 2 | 16 CW, 9 CCW |
| 2 Medium-low | 3 | 14 CW, 8 CCW |
| 3 Medium | 4 | 12 CW, 7 CCW |
| 4 Medium-strong | 5 | 10 CW, 6 CCW |
| 5 Strong | 6 | 8 CW, 5 CCW |

TABLE II

| | SINGLE LOOPED BAND | |
|---|---|---|
| Resistance | No. Start Bands | No. Turns |
| 1 Low | 1 | 12 CW, 10 CCW |
| 2 Medium | 2 | 11 CW, 9 CCW |
| 3 Strong | 3 | 10 CW, 8 CCW |

TABLE III

| | DOUBLE LOOPED BAND | |
|---|---|---|
| Resistance | No. Start Bands | No. Turns |
| Strong | 1 | 8 CW, 7 CCW |

The specifications set forth in TABLE I are for exercise devices using a single band 51 (FIG. 2) as the starting bands and a single locking band. The number of starting bands may vary from two through six to provide exercise resistances which range from a low value to a strong value. The number of turns in the clockwise direction for the starting bands and in the counter-clockwise direction for the locking band are set forth in TABLE I.

TABLE II sets forth the specifications for starting bands incorporating a single looped type band 52 (FIG. 3) which may include 1–3 starting bands and a single locking band 51 (FIG. 2). TABLE III sets forth specifications for a double looped starting band 53 (FIG. 4) and a single locking band 51 (FIG. 2).

Figure 9:
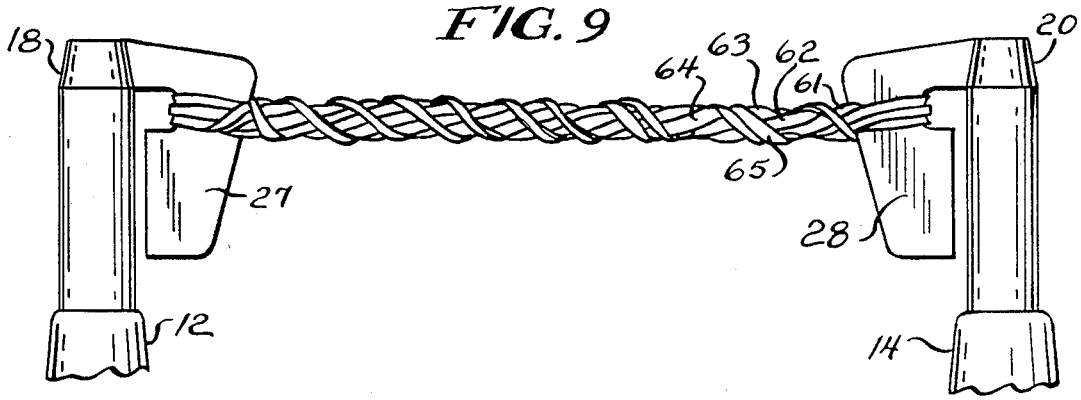
FIG. 9 illustrates the exercise device shown in FIG. 8 with the locking band installed.

An example of a resilient link which provides medium resistance for the exercise device 10 is illustrated in FIGS. 8 and 9. FIG. 8 illustrates starting bands wound on the spinner members 18 and 20, prior to installation of a locking band. In FIG. 8, the resilient link 16 includes four starting bands 61–64 of single band configuration 51, FIG. 2, and a single locking band. The starting bands 61–64 are wound twelve turns clockwise in the manner described above, providing the configuration illustrated in FIG. 8. Then, the locking band 65 is installed and wound seven turns counter-clockwise in the manner described above, providing the configuration illustrated in FIG. 9.

Figure 10:
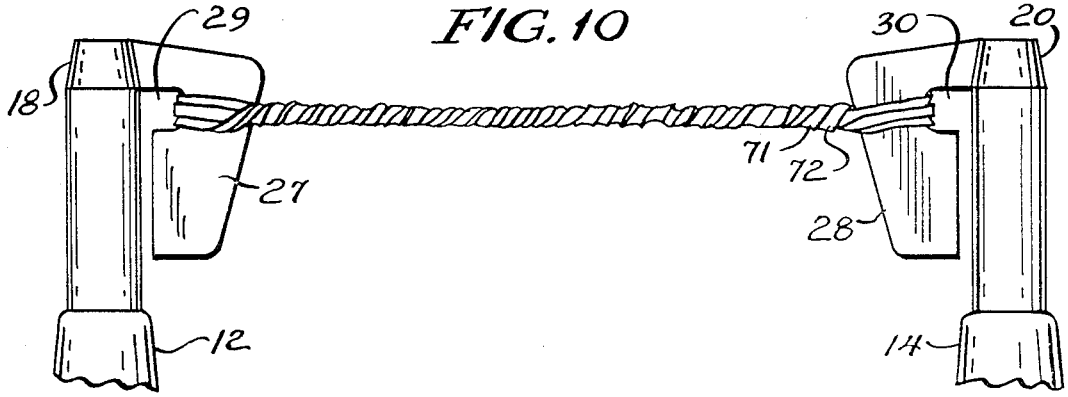
FIG. 10 illustrates a further winding arrangement for a starting band for providing strong resistance for the exercise device.
Figure 11:
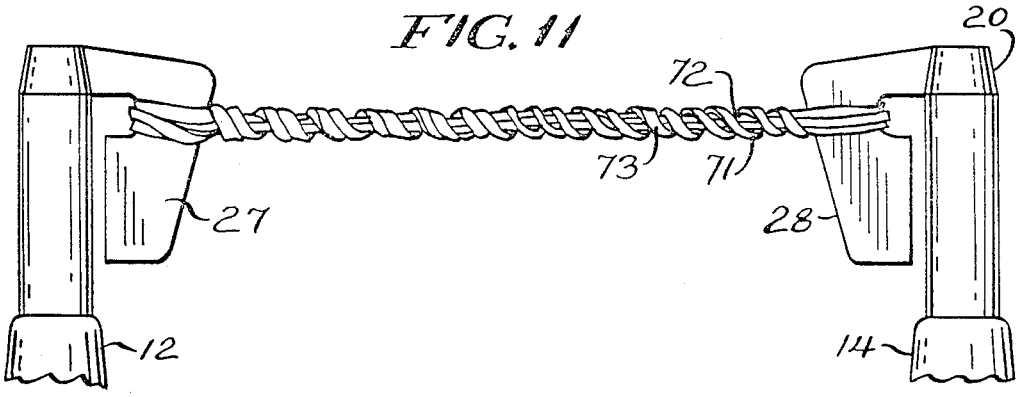
FIG. 11 illustrates the exercise device of FIG. 10 with the locking band installed.

FIG. 10 illustrates a further embodiment in which a single looped band configuration (FIG. 3) is employed. In FIG. 10, a single starting band 71 having loops 72 and 73 is employed. The starting band 71 is looped over the spinner members 18 and 20 and is wound twelve turns clockwise providing the configuration illustrated in FIG. 10. The locking band 74 is then installed on the spinner members 18 and 20 and wound ten turns counter-clockwise. This provides a low resistance for the exercise device.

It is readily apparent that the exercise device or apparatus in accordance with the present invention has particular application in exercising and developing the muscles of the hands and arms used in various sports such as golf, tennis, baseball, bowling or the like. The device may be used by the user in a seating position or in a standing position wherein the hands, wrists and forearms of the user may be moved through the entire range of movement necessary for participating in a particular sport to develop the particular muscles necessary to properly engage in the sport.

I claim:

1. An exercising device comprising:

a pair of elongated tubular handles each having an end portion and a gripping portion extending substantially the length of said handle opposite said end portions, with each of said end portions providing a tubular shaft;

each of said end portions including a spinner member adapted for rotation relative to said handle and having a hook portion;

resilient means attached to said hook portions of said spinner members, interconnecting said ends of said handles;

said resilient means applying a variable resistance against the reactive universal movement of the handles with respect to each other;

said resilient means including at least a first member of a resilient material, wound in one direction to impart a twisting torque thereto and at least a second member of a resilient material wound on said first member along substantially the entire length thereof in the opposite direction to equalize the twisting torque.

2. The device according to claim 1, wherein said first and second members each comprise an endless band of a resilient material.

3. An exercising device comprising:

a pair of elongated tubular handles each having an end portion and a gripping portion extending substantially the length of said handle opposite said end portions, with each of said end portions providing a tubular shaft;

each of said end portions including a spinner member adapted for rotation relative to said handle and having a hook portion;

resilient means attached to said hook portions of said spinner members, interconnecting said ends of said handles;

said resilient means applying a variable resistance against the reactive universal movement of the handles with respect to each other;

said resilient means including a plurality of bands wound together and a further band wound on said plurality of bands, said plurality of bands being wound in one direction to impart a twisting torque thereto and said further band being wound on said plurality of bands in the opposite direction to equalize the twisting torque.

4. The device according to claim 3, wherein said plurality of bands includes first and second bands wound together spirally in a first direction, and said further band being wound spirally on said first and second bands in the opposite direction.

5. An exercising device comprising:

a pair of elongated tubular handles each having an end portion and a gripping portion extending substantially the length of said handle opposite said end portions, with each of said end portions providing a tubular shaft;

each of said end portions including a spinner member adapted for rotation relative to said handle and having a hook portion;

resilient means attached to said hook portions of said spinner members, interconnecting said ends of said handles;

said resilient means applying a variable resistance against the reactive universal movement of the handles with respect to each other;

said resilient means including at least first and second endless bands of a resilient material, said first band including a plurality of loops wound together to impart a twisting torque thereto and said second band being wound on said first band along substantially the entire length thereof to equalize the twisting torque.

6. The device according to claim 5, wherein said plurality of loops are wound spirally together in first direction and said second band is wound spirally on said first band in the opposite direction.

7. The device according to claim 5, wherein said resilient means includes 2+n starting bands wound 16−n turns in one direction and a locking band wound on said starting bands in the opposite direction 9−n turns, where n is in the range of zero to four.

8. The device according to claim 5, wherein said resilient means includes 1+n starting bands, each defining two loops wound 12−n turns in one direction and a locking band on said starting bands wound 10−n turns in the opposite direction, where n is in the range of zero to three.

9. The device according to claim 5, wherein said first band defines four loops which are wound eight turns in one direction and said second band is wound seven turns in the opposite direction.

10. An exercising device comprising:

a pair of elongated tubular handles each having an end portion and a gripping portion extending substantially the length of said handle opposite said end portions, with each of said end portions providing a tubular shaft;

each of said end portions including a spinner member having a hook portion;

resilient means attached to said hook portions of said spinner members, interconnecting said ends of said handles;

said resilient means applying a variable resistance against the reactive universal movement of the handles with respect to each other;

said resilient means including at least one starting band and at least one locking band of a resilient material, said starting band being wound in one direction to impart a twisting torque thereto and said locking band being wound on said starting band in the opposite direction to equalize the twisting torque.

* * * * *